US005768836A

United States Patent [19]

Bachmann

[11] Patent Number: 5,768,836

[45] Date of Patent: Jun. 23, 1998

[54] HEAT AND SOUND TRANSMISSION ATTENUATED FRAMING STRUCTURE, PARTICULARLY DOOR OR WINDOW FRAMING

[75] Inventor: Otto Bachmann, Hochdorf, Switzerland

[73] Assignee: Sunshine Engineering AG, Hochdorf, Switzerland

[21] Appl. No.: 751,635

[22] Filed: Nov. 18, 1996

[30] Foreign Application Priority Data

Nov. 21, 1995 [CH] Switzerland ..... 03 289/95

[51] Int. Cl.[6] ..... E06B 3/32

[52] U.S. Cl. ..... 52/204.51; 52/396.04; 49/504; 49/DIG. 1

[58] Field of Search ..... 52/204.51, 235, 52/393, 396.04, 396.05; 49/404, 504, DIG. 1, DIG. 2

[56] References Cited

U.S. PATENT DOCUMENTS

| | | | |
|---|---|---|---|
| 3,780,473 | 12/1973 | Kort et al. . | |
| 3,908,313 | 9/1975 | Bierlich | 49/DIG. 1 X |
| 4,115,972 | 9/1978 | Varlonga | 49/DIG. 1 X |
| 4,219,983 | 9/1980 | Kern et al. | 49/DIG. 1 X |
| 4,432,179 | 2/1984 | Bachmann . | |
| 4,455,800 | 6/1984 | Hosooka et al. | 49/DIG. 1 X |
| 4,524,112 | 6/1985 | Willert . | |
| 4,614,062 | 9/1986 | Sperr | 49/DIG. 1 X |

FOREIGN PATENT DOCUMENTS

| | | |
|---|---|---|
| 0 053 998 | 6/1982 | European Pat. Off. . |
| 0 100 991 | 2/1984 | European Pat. Off. . |
| 26 34 668 | 2/1977 | Germany . |
| 26 08 299 | 9/1977 | Germany . |
| 42 38 750 | 5/1994 | Germany . |
| 43 21 702 | 1/1995 | Germany . |
| 44 03 844 | 8/1995 | Germany . |
| 44 09 315 | 9/1995 | Germany . |
| 656 669 | 7/1986 | Switzerland . |

OTHER PUBLICATIONS

"Nuova Finestra", vol. 14, No. 3, Mar. 1993, Milan, Italy, pp. 198–207.

*Primary Examiner*—Christopher Kent
*Assistant Examiner*—Yvonne Horton-Richardson
*Attorney, Agent, or Firm*—Frishauf, Holtz, Goodman, Langer & Chick, P.C.

[57] ABSTRACT

To improve thermal and acoustic insulation between the outside (O) and the inside (I) of a structure having windows or doors therethrough, stationary frames (10, 12; 52, 54) are secured to the building, retaining movable window or door frames (2). The stationary frames include two metal rails (10, 12; 52, 54), one (10, 52) of the frames being located at the outside (O) of the building and the other (12, 54) at the inside (I) of the building. The inner and outer rails are separated from each other by a double-walled chambered strip (14) having first and second elongated strip portions connected by cross ribs (21, 22, 23) which, therebetween, define chambers (17–20). The chambers are serially located in a direction of thermal gradient between the outside and the inside of the building and arranged in stepped or Z-shaped configuration. The chambered strips are rigidly connected at lateral portions thereof with the inside and outside rails, for example by interengaging, interlocking arrangements including interfitting dovetail-shaped portions.

18 Claims, 2 Drawing Sheets

HEAT AND SOUND TRANSMISSION ATTENUATED FRAMING STRUCTURE, PARTICULARLY DOOR OR WINDOW FRAMING

Reference to related patent, the disclosure of which is hereby incorporated by reference, by the inventor hereof:

U.S. Pat. No. 4,432,179, Bachmann.

Reference to related patents, the disclosures of which are hereby incorporated by reference:

U.S. Pat. No. 4,524,112, Willert

U.S. Pat. No. 3,780,473, Kort et al.

FIELD OF THE INVENTION

The present invention relates to a framing or rail construction, for doors, windows, and the like, and especially to such a construction which has improved attenuation of heat and sound transmission between the outside of a building and the inside thereof.

BACKGROUND

U.S. Pat. No. 4,432,179, Bachmann, the inventor of this application, describes a window or door construction in which two serially located—in direction of heat flow—heat insulating strips are coupled to aluminum profiled rails. Together with the window itself, air chambers are formed which provide for attenuation of heat and sound transmitted from the outside to the inside.

THE INVENTION

It is an object to improve a window or door construction of the general type described in the aforementioned Bachmann patent by descreasing manufacturing costs while further increasing the attenuation of heat and sound through the window or door. The resulting construction, additionally, should be slim and have a pleasing aspect.

Briefly, a sound and heat insulating structure is located between two metal rails, typically of aluminum, which retain window glazing or door panels, which is formed as a double-walled, thermally and acoustically separating, yet structurally coupling element in form of a multiple chambered strip. The double-walled chambered strip has first and second elongated strip portions which are connected, intermediate their lengths, by cross ribs, thereby defining a plurality of thin-walled chambers therebetween, while ensuring necessary strength and stiffness. The chambers are located serially in the direction of thermal gradient or an acoustic path between the inside and the outside of the building. The chambers in the strips are placed, preferably, in staggered arrangement (with respect to a dimension transverse to the longitudinal extent of the inside and outside) or in Z-shape configuration. Connection elements likewise staggered rigidly couple the lateral portions of the insulating strip with the inside and outside rails of the window or frame structure itself.

The their-walled chambered strip is, preferably, made of a hard plastic material of suitably profiled shape. At least three, preferably four serially placed chambers are formed in, what might be termed a hive pattern, to form air chambers which increase the heat insulation between the inside and the outside of the building, by forming climatic zones in the direction of heat transmission with clear thermal separation of the inner and outer metal rails of the window or door, respectively. The frames themselves can be slim, so that the window area, and hence light passage through the window, can be high, since an extensive clear window surface is available within the frame itself.

The construction is simplified, and the precision and stiffness of the cooperating coupled elements is improved over that of the prior art. Only two metal profiled rails are necessary which, to complete the frames, are coupled together with the chambered plastic connecting strips.

DRAWINGS

FIG. 1 is a fragmentary vertical section through a window construction attached to a wall portion of a building, and illustrating the metal rails and the structure and placement of the plastic coupling element; and FIG. 2 is a horizontal sectional view through a double-casement window construction.

DETAILED DESCRIPTION

Figure 1:
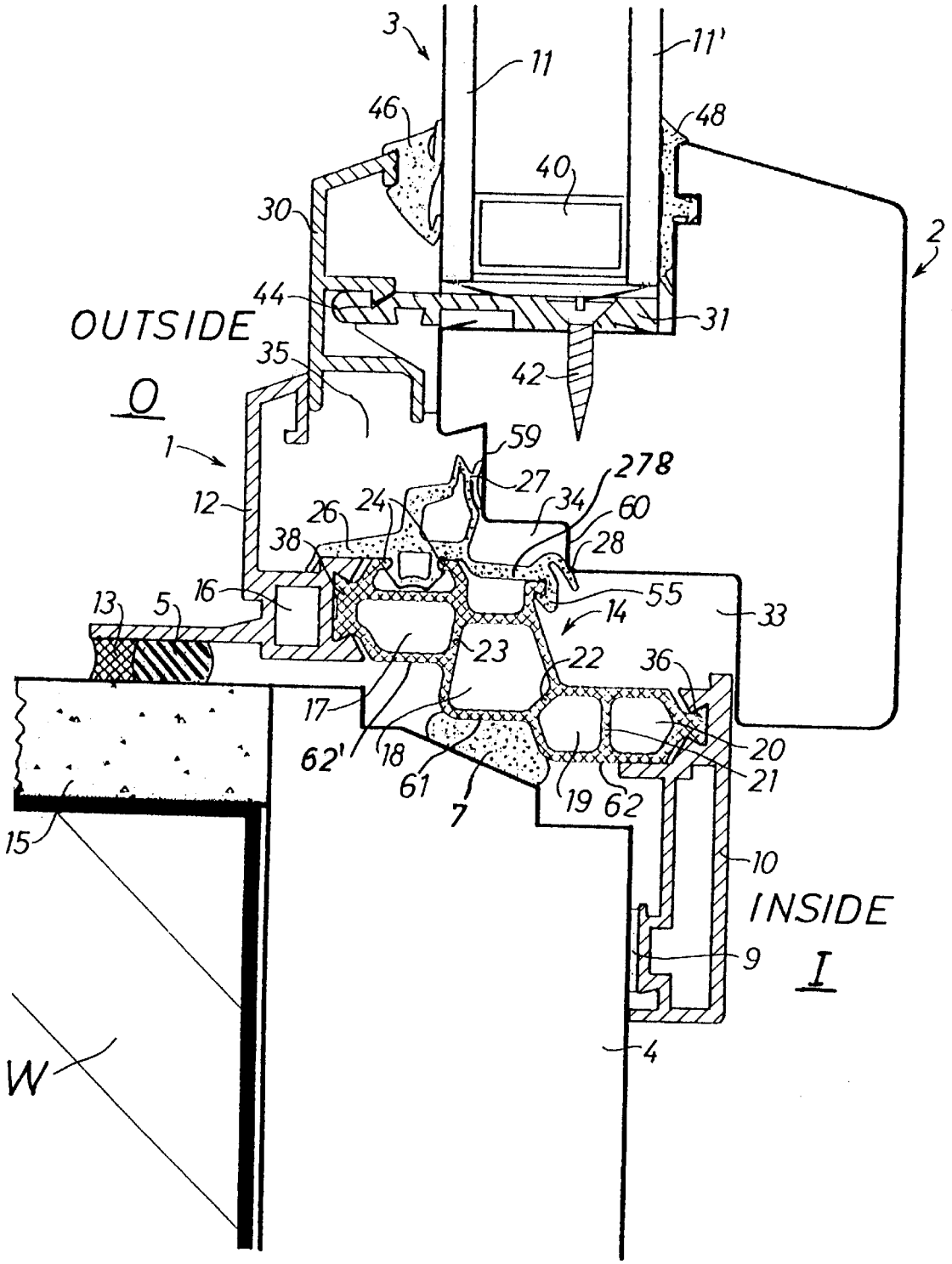

Referring first to FIG. 1: A stationary, fixed frame 1, coupled to a wall W cooperates with a movable window frame 2. For purposes of illustration, the window is shown as a casement window. The window of frame 2 is completed by an insulated glazing 3. The glazing 3 is formed by two glass panes 11, 11', spaced from each other by a spacer 40. The glass panes 11, 11' are made of insulating glass and are supported, as well known, by elastic glass holders 46, 48.

The stationary frame 1 is coupled, as well known, to a stationary wooden frame 4 and connected thereto by screws or the like, not further shown, in well-known manner. Sealing is obtained by conventional seals 5, 7, 9, 13. The seals 5, 13 engage against a plate 15 which is fitted on the wall W of a building or the like. The plate 15, itself, may be a masonry or other construction.

In FIG. 1, the left side of the illustration is at the outside O of the building, whereas the right side at the inside I of the building. At the inner side of the building, that is, at the room side, at metal profiled rail 10 forms part of the fixed frame 1. Preferably, the rail 10 is made of aluminum. A second rail 12 of the frame 1, also preferably of aluminum, is located at the outside O.

In accordance with a feature of the invention, the two metal profiled rails 10, 12 are coupled together by a unitary chambered profiled strip 14 made of hard or thermosetting plastic. The profiled strip 14 is clamped and securely held in position on and against the two metal profiled rails 10, 12 by dovetail connections 36, 38, which clamp the rails 10, 12 to strip 14, and hence secure rails 10, 12 together. The plastic strip 14 is hollow and defines at least three, preferably four, longitudinally staggered air chambers 17, 18, 19, 20, located in the direction of heat gradient between the outside O and the inside I of a building, as well as in the direction of sound transmission between the outside O and the inside I. The chambers 17, 18, 19, 20 are circumferentially closed by relatively thin walls of the plastic material of strip 14, that is, the wall thickness of the plastic defining the chambers is thin with respect to cross-sectional dimensions of the chambers (see FIG. 1). The chambers are separated from each other by relatively thin-walled cross strips 21, 22, 23. Chambers 17–20 may be of different size; preferably, an intermediate chamber 18 is the largest one. Since the chambers 17–20 are longitudinally serially arranged, with respect to the heat gradient or heat transmission, a plurality of individually separated climatic zones will occur between the metal profiled rail 12 at the outside and the metal profiled rail 10 at the inside of the building. The plastic strip 14 has, generally, a Z-shaped cross section, so that the attachment points of the two rails 10, 12 with the strip 14 are vertically staggered.

The chambered profiled strip 14, preferably, is made of glass fiber-reinforced polyamide, or of polypropylene, which, also, may be reinforced. The fixed stiff connection between the metal profiled rails 10, 12 and the strip 14 is obtained by compression of portions of the rails 10, 12, which overlap, and engage over, the dovetail profiles 36, 38 of the strip 14; preferably, the projections are shaped to fit over, and snugly engage with, the dovetail end portions 36, 38 of the strip 14.

Two oppositely directed ribs 24 project from the strip 14, to thereby define a dovetail-shaped groove. This groove is used to retain a sealing strip 26 formed of a relatively soft elastic material. The sealing strip 26 has a first sealing lip 27, engaging against a stepped portion 59 of the casement frame 2, and a second sealing lip 28, spaced from the first sealing lips 27, and engaging a further edge 60 formed on the frame 2 which, the window shown being a casement window, is swingable towards the inside I of the building. An elongated hooked arm 278 connects the sealing lips 27 and 28.

The window frame element 2, usually, is already present. The portion of the frame element 2 which is facing the outside is coupled to a rail 30 by means of a cross element 31, secured in the frame 2 by screws, only one of which is shown at 42. The rail element 30 is hooked into a groove 44 formed in the cross element 31.

When the window formed by frame 2 and the glazing 3 is closed, additional air chambers 33, 34, 35 will form; a further chamber 16 in rail 12, and chambers 33, 34, 35 also enhance the attenuation of heat and sound transmission. The chambers 17, 18, 19 have flat bottom walls. The strip 14 is also supported on the frame 4 by a flat surface 61 lying on seal 7. Surfaces 62 and 62', parallel to surface 61, are staggered with respect to surface 61.

This window and/or door construction is particularly suitable for renovation work, in which existing structures 4 and 2 of wood are to be re-used. Due to the offset stepped construction of the strip 14, as well as of the rails 10, 12, the glass surface available for light transmission is hardly decreased with respect to a window which may have been installed in the wooden frames before renovation, and after the renovation, replaced with the aluminum framing, in accordance with the present invention.

Figure 2:
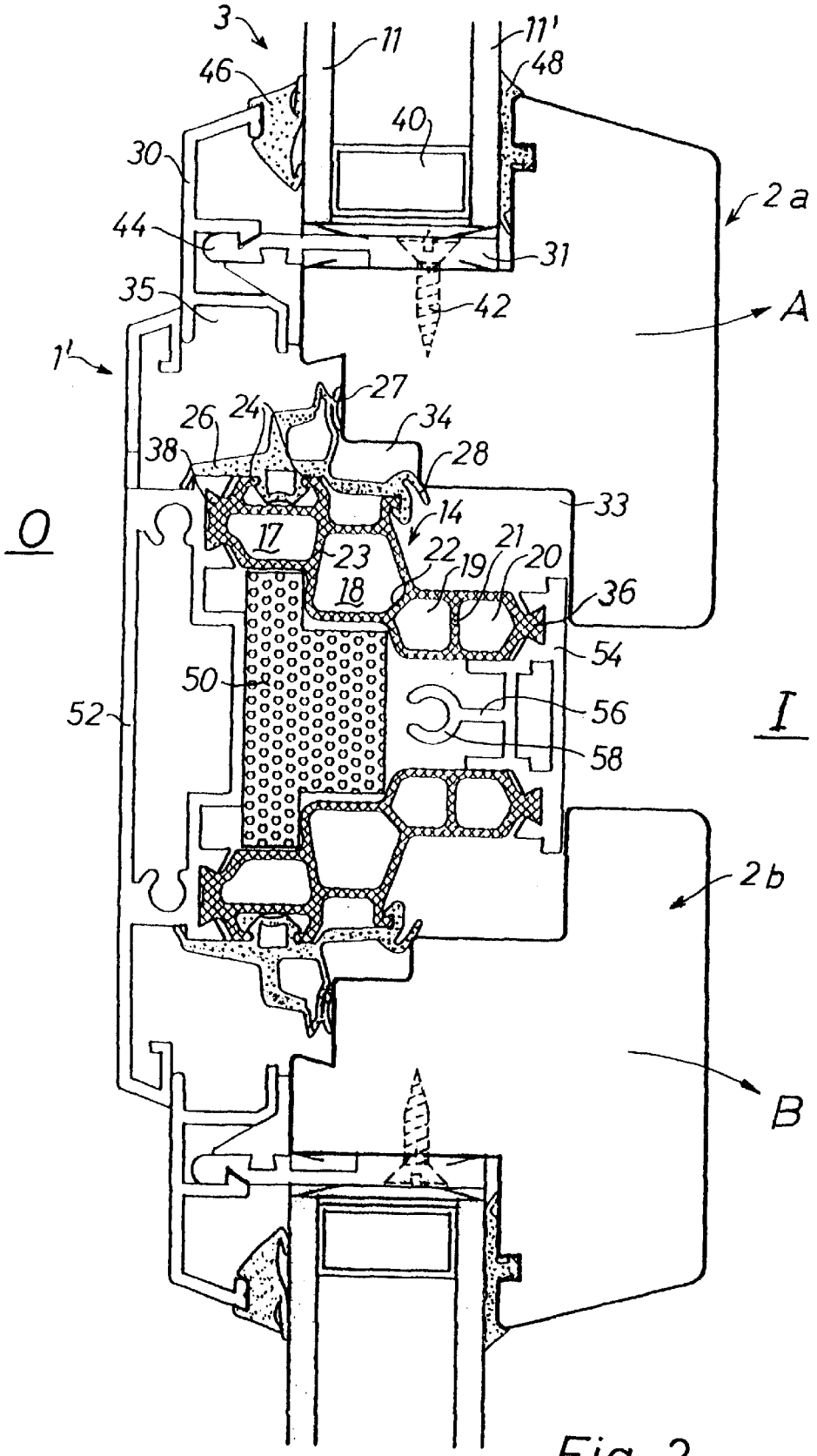

FIG. 2 illustrates a double casement window construction, having two window units 2*a*, 2*b* which can be opened in the direction of the arrows A, B. A central post 50 is provided against which the two plastic strips 14 engage. The outer portion 1' of the window, formed by rail 52, extends across the central post. The inner rail 54, corresponding to rail 10 in FIG. 1, is much shorter. The rails 52, 54 are differently shaped, and each of them is coupled to the profiled strips 45 rigidly and securely by dovetail, interengaging couplings, as shown in FIG. 2. The rail 54 is formed with a central web 56 which can be formed, in part, with a ring-shaped extension, which may have utility in some installations, but is not used in connection with the present invention. Other than the shape of the rails 52, 54 and of the central post 50, all elements are identical to those previously described in connection with FIG. 1, and are located mirror-symmetrically with respect to each other. The same structural elements, other than the rails, thus can be used for single as well as for double casement windows, or for single or double doors.

Various changes and modifications may be made, and any features described herein in connection with any one of the embodiments may be used with the other, within the scope of the inventive concept.

I claim:

1. A heat and sound transmission attenuated framing structure, optionally a door or window framing structure, for installation in a building having a stationary frame (1, 1') and a movable window or door frame (2, 2*a*, 2*b*);

two metal rails (10, 12; 52, 54), one (10, 52) of said rails being an inside rail located at an inner side (I) of the building and the other (12, 54) being an outside rail, located at an outer side (O) of the building; and a heat and sound insulating structure located between said inside and outside rails, wherein the heat and sound insulating structure comprises a thin-walled chambered strip (14) of hard plastic material having first and second thin-walled elongated strip portions and thin-walled cross ribs (21, 22, 23) between said strip portions, thereby defining at least three, and optionally four chambers (17–20), in which at least two of said chambers are of different size, said chambers being serially located in the direction of thermal gradient between the outside (O) and the inside (I) of the building, said chambers (17–20) in said strip (14) being located, with respect to a dimension transverse to the longitudinal extent of the outer or inner one of said rails, in staggered or Z-shaped configuration;

wherein the metal rails (10, 12; 52, 54) and the end portions of said strip (14) are formed with interlocking, dovetail and respectively staggered connection arrangements, provided, respectively, on said rails and the end portions of said chambered strip (14) to form a connection means securely connecting opposite lateral portions of the chambered rail (14) with said inside and outside rails (10, 12; 52, 54) respectively, wherein at least one of said strip portions of the chambered strip is formed with an essentially flat, parallel surface (61, 62) facing a portion (4) of the building;

wherein support means (7) are provided between at least one (61) of said essentially flat surfaces (61, 62) and said portion (4) of the building;

wherein at least one of said strip portions of said chambered strip (14), opposite an outermost chamber (17), is formed with two oppositely directed ribs (24) defining a re-entrant dovetailed opening;

a rubber-elastic strip (26) is provided, fitted in said re-entrant dovetailed opening and in engagement with a portion of the movable window or door frame (2, 2*a*, 2*b*); and wherein said sealing strip (26) is formed with at least one sealing extension or sealing lip (27, 28) engaging against the movable window or door frame (2, 2*a*, 2*b*).

2. The framing structure of claim 1, wherein said structure has two mirror-symmetrical movable frames (2*a*, 2*b*) and a center post (50) therebetween to form a dual structure;

two chambered strips (14) are provided, and said two metal rails (52, 54) are rigidly connected to lateral portions of each of said chambered strips, said central post (50) forming a spacer element between said two chambered strips (14).

3. The framing structure of claim 1, wherein the rubber-elastic sealing strip (26) has a first sealing lip (27) for engaging a first stepped portion (59) of the frame (2) and an elongated hooked arm (278) with a second sealing lip (28), spaced from the first sealing lip (27) in thermal gradient direction, for engaging a second stepped portion (60) of the frame.

4. The framing structure of claim 1, wherein the window construction (2) is made of wood.

5. The framing structure of claim 1, wherein said hard plastic material is polyamide, optionally reinforced with glass fibers, or polypropylene.

6. The framing structure of claim 2, wherein the rubber-elastic sealing strip (26) has a first sealing lip (27) for engaging a first stepped portion (59) of the frame (2) and an elongated hooked arm (278) with a second sealing lip (28) spaced from the first sealing lip (27) in thermal gradient direction for engaging a second stepped portion (60) of the frame.

7. The framing structure of claim 2, the window construction (2) is made of wood.

8. The framing structure of claim 3, wherein the window construction (2) is made of wood and the stationary frame (4) is made of wood.

9. The framing structure of claim 6, wherein said hard plastic material is polyamide, optionally reinforced with glass fibers, or polypropylene.

10. The framing structure of claim 7, wherein said hard plastic material is polyamide, optionally reinforced with glass fibers, or polypropylene.

11. The framing structure of claim 8, wherein said hard plastic material is polyamide, optionally reinforced with glass fibers, or polypropylene.

12. The framing structure of claim 9, wherein said hard plastic material is polyamide, optionally reinforced with glass fibers, or polypropylene.

13. The framing structure of claim 1, wherein the metal rails (10, 12; 52, 54) are of aluminum.

14. The framing structure of claim 2, wherein the metal rails (10, 12; 52, 54) are of aluminum.

15. The framing structure of claim 4, wherein the metal rails (10, 12; 52, 54) are of aluminum.

16. The framing structure of claim 5, wherein the metal rails (10, 12; 52, 54) are of aluminum.

17. The framing structure of claim 6, wherein the metal rails (10, 12; 52, 54) are of aluminum.

18. The framing structure of claim 8, wherein the metal rails (10, 12; 52, 54) are of aluminum.

* * * * *